United States Patent [19]

Post

[11] 4,238,071

[45] Dec. 9, 1980

[54] AIR CONDITIONING SYSTEM AND CONTROL THEREFOR

[75] Inventor: John E. Post, Cincinnati, Ohio

[73] Assignee: Carrier Corporation, Syracuse, N.Y.

[21] Appl. No.: 53,599

[22] Filed: Jun. 29, 1979

[51] Int. Cl.[3] ..... F24F 7/04

[52] U.S. Cl. ..... 236/49; 62/186

[58] Field of Search ..... 236/49, 13; 62/186

[56] References Cited

U.S. PATENT DOCUMENTS

| | | | |
|---|---|---|---|
| 3,720,258 | 3/1973 | Chandler | 236/49 X |
| 3,753,184 | 8/1973 | Holloway | 236/49 X |
| 3,824,800 | 7/1974 | Church | 62/186 |
| 3,915,376 | 10/1975 | Attridge, Jr. et al. | 236/49 X |
| 4,120,453 | 10/1978 | Herb et al. | 236/49 |

*Primary Examiner*—Albert J. Makay
*Assistant Examiner*—William E. Tapolcai, Jr.
*Attorney, Agent, or Firm*—J. Raymond Curtin; John S. Sensny

[57] ABSTRACT

A control for an air conditioning system of the type wherein a supply of air is conditioned at a central station, conditioned air is conducted through a supply air duct to a plurality of zones, and a plurality of discharge terminals discharge conditioned air from the supply air duct into the zones. The control comprises a plurality of air control valves, wherein each discharge terminal includes an air control valve for controlling the amount of conditioned air discharged into a zone by the discharge terminal; and a plurality of thermostatic adjusting devices, wherein each discharge terminal includes a thermostatic adjusting device for adjusting the air control valve to inversely vary the amount of air discharged into the zone in response to changes in the air temperature thereof. The control further comprises a primary override switch, wherein a first selected discharge terminal includes the primary override switch for overriding the thermostatic adjusting device of the first selected discharge terminal to increase the amount of air discharged into a first selected zone during a warm-up period when the temperature of the air passing through the supply air duct exceeds a predetermined value; and an auxiliary override switch, wherein a second selected discharge terminal includes the auxiliary override switch for overriding the thermostatic adjusting device of the second selected discharge terminal to substantially restrict the discharge of air into a second selected zone during the warm-up period to prevent overheating thereof.

5 Claims, 4 Drawing Figures

AIR CONDITIONING SYSTEM AND CONTROL THEREFOR

BACKGROUND OF THE INVENTION

This invention relates generally to air conditioning systems, and more particularly to controls therefor.

Air conditioning systems are employed to discharge conditioned air into a zone or room requiring conditioned air for the comfort of the occupants thereof. The conditioned air compensates for heat developed in the room from, inter alia, lights, electric machines, occupants, and solar heat developed via radiation and conduction. Typically, in installations such as office buildings, schools, and other multi-room buildings, air is conditioned at a central station and supplied to air discharge or distribution terminals provided in each of the rooms via one or more supply air ducts. Air is then returned to the central station for reconditioning via return air ducts.

In many applications, it is desirable to maintain the quantity of air directed into a room independent of changes in the supply air pressure. For this reason, room discharge terminals of air conditioning systems are generally provided with a valve or valve means for restricting the flow of conditioned air into the room, with the valve or valve means controlled by a signal indicative of the supply air pressure. The valve or valve means is automatically adjusted in response to changes in the supply air pressure so that the amount of air flowing through the valve or valve means is kept relatively independent of fluctuations in the supply air pressure. In many of these same applications, it is desirable, in contrast, to reduce the quantity of conditioned air supplied to the room in response to variations in the air temperature of the room. Accordingly, many room air discharge terminals also include a thermostat or thermostatic control means for sensing the temperature of the air within the room and modifying the control signal supplied to the valve means of the discharge terminal to reduce the quantity of air delivered therefrom as the air temperature of the room approaches a desired level.

Usually, during the evening hours, holidays, or weekends, the cooling load in many rooms of multi-room buildings becomes almost negligible due to elimination of almost all the heat producing elements. However, even those air conditioning systems utilizing room discharge terminals with thermostat controls generally continue to discharge a minimum amount of conditioned air into the rooms of the building, lowering the air temperature of the rooms to a level which may be uncomfortably cool for the occupants initially entering such rooms immediately following the low load period.

Even if the air conditioning system is shut down during a low load period, thus eliminating the flow of conditioned air into the rooms, overcooling of various rooms may still occur via transmission of heat to the outdoors through the walls and windows of the building.

To compensate for such overcooling, many central air conditioning systems of the general type heretofore discussed supply relatively warm air to the rooms of the building shortly before the occupants thereof are due to arrive. The normal thermostatic controls of the room air discharge terminals, sensing the very cool air within the rooms, tend to severely restrict the amount of warm air directed into the rooms. During this warm-up period, such a restriction is generally undesirable and, conventionally, discharge terminals serving those rooms which need warm-up air are each provided with an override control, often referred to as a "warm-up switch", which senses the flow of relatively warm air in the supply air duct and prevents the normal thermostatic control from restricting the flow of this warm air. Thus, the temperature level in the rooms may be readily and rapidly increased to a satisfactory level before the occupants thereof arrive, eliminating occupant dissatisfaction due to excessively low temperature levels.

For one reason or another, however, some rooms of a building may not need a warm-up period. For example, often electrically powered equipment such as computers, photocopiers, and typewriters are concentrated in a few rooms of a building and are almost constantly operated. With the nearly continuous operation of this heat producing equipment, these rooms seldom, if ever, become overcooled. During a warm-up period, the normal thermostatic controls of the discharge terminals serving these rooms, sensing the relatively warm air within the rooms, tend to allow a comparatively large amount of air into the rooms. This, of course, further warms the rooms and, as the rooms warm, the thermostatic controls tend to allow even more air into the rooms. Directing warm-up air to the rooms which do not need it is a waste of the warm air and, in fact, may cause discomfort to the occupants thereof and reduce the efficiency of the complex machinery therein.

SUMMARY OF THE INVENTION

In view of the above, an object of this invention is to improve central air conditioning systems, particularly controls therefor.

Another object of the present invention is to provide a unique apparatus for controlling the amount of conditioned air supplied to a plurality of zones.

A further object of this invention is to prevent warm-up air from entering a room or a zone where it is not needed.

Still another object of the present invention is to override the normal thermostatic control of a room air distribution terminal to substantially restrict the amount of air supplied to a zone when the temperature of the air supplied thereto exceeds a predetermined level.

Another object of this invention is to selectively provide each room of a building with warm-up air depending on the individual needs and requirements of the room.

These and other objectives are attained with a control for an air conditioning system of the type wherein a supply of air is conditioned at a central station, conditioned air is conducted through a supply air duct means to a plurality of zones, and a plurality of discharge terminal means discharge conditioned air from the supply air duct means into the zones. The control comprises a plurality of air control means, wherein each discharge terminal means includes an air control means for controlling the amount of conditioned air discharged into a zone by the discharge terminal means; and a plurality of thermostatic adjusting means, wherein each discharge terminal means includes a thermostatic adjusting means for adjusting the air control means to inversely vary the amount of air discharged into the zone in response to changes in the air temperature thereof. The control further comprises primary override means, wherein a first selected discharge terminal means includes the primary override means for overriding the thermostatic adjusting means of the first selected discharge terminal means to increase the amount of air discharged into a first selected zone during a warm-up period when the temperature of the air passing through the supply air duct means exceeds a predetermined value; and auxiliary override means, wherein a second selected discharge terminal means includes the auxiliary override means for overriding the thermostatic adjusting means of the second selected discharge terminal means to substantially restrict the discharge of air into a second selected zone during the warm-up period to prevent overheating thereof.

DESCRIPTION OF THE PREFERRED EMBODIMENT

Figure 1:
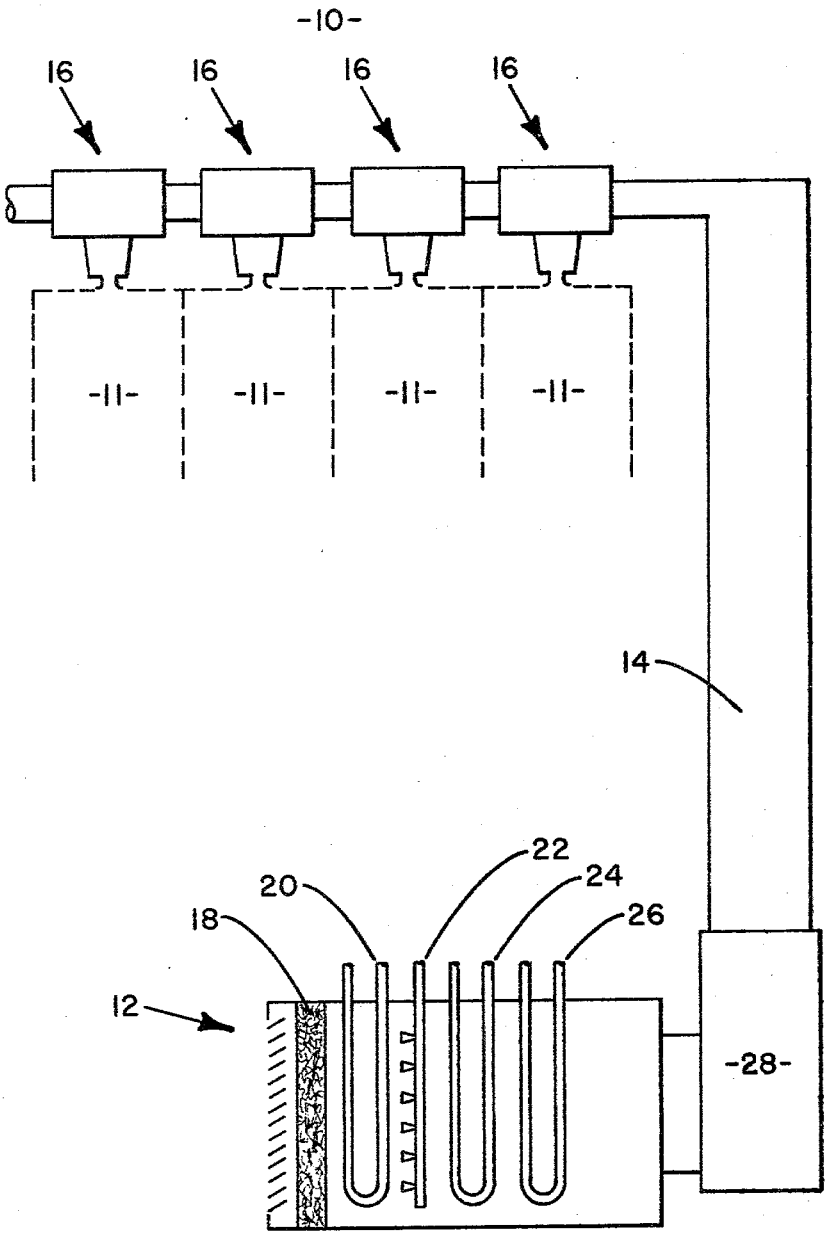
FIG. 1 is a schematic view of a central air conditioning system employing the present invention.

Referring particularly to FIG. 1, there is illustrated central air conditioning system 10 for supplying conditioned air to a plurality of rooms or zones 11 within a building. System 10 comprises, generally, central station 12 for conditioning air, supply air duct 14 for conducting conditioned air from the central station to the zones 11, and a plurality of distribution or discharge terminals 16 for directing conditioned air from the supply air duct into the zones.

Central station 12 includes filter 18, precooling coil 20, spray means 22, cooling coil 24, and heating coil 26 for heating, cooling, humidifying, and filtering a quantity of air as desired.

Fan 28 is provided for circulating air through system 10. Conditioned air is drawn from central station 12 by fan 28 and directed into and through supply air duct 14. The illustrated supply air duct 14 represents a plurality of ducts to conduct conditioned air to room air discharge terminals 16 disposed throughout the building. In the preferred embodiment, each room air discharge terminal 16 is a ceiling terminal, extending through the ceiling of the room or zone 11 into which the terminal directs conditioned air. It should be specifically understood, though, that other types of room air discharge or distribution terminals are well known to those skilled in the art and may be employed in the practice of the present invention. For example, induction terminals or units may be utilized in lieu of the ceiling terminal hereinafter described in detail.

Figure 2:
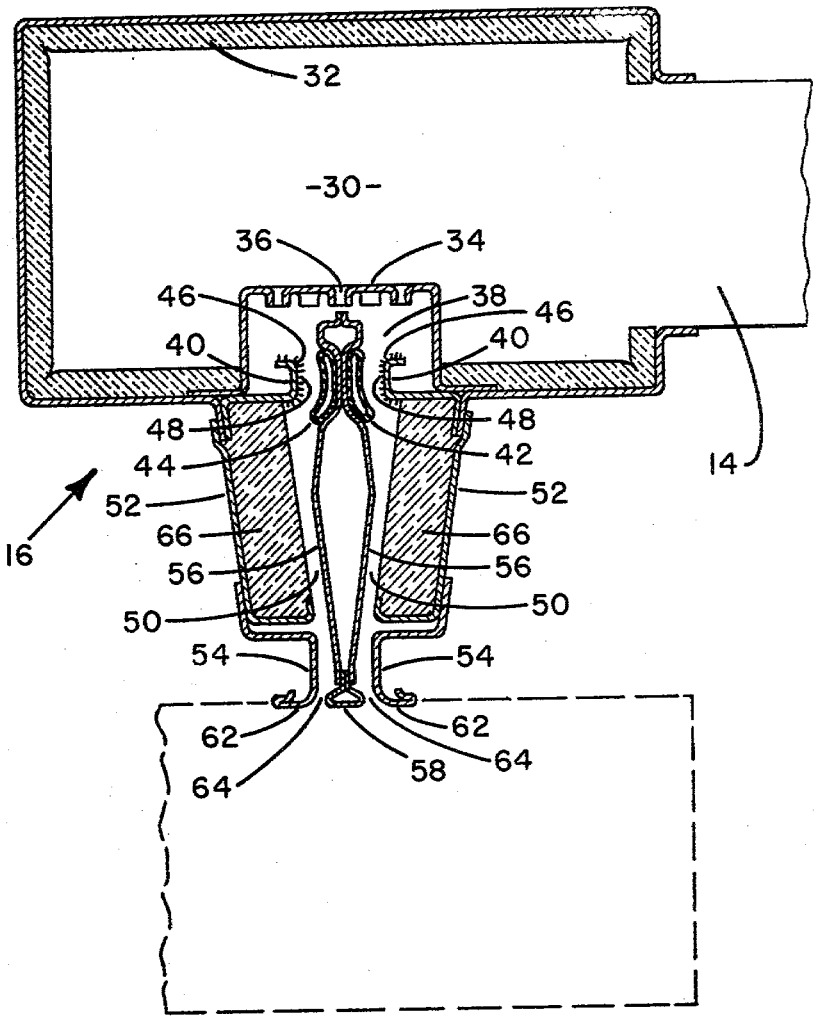
FIG. 2 is a schematic view illustrating in section a room air discharge terminal of the system shown in FIG. 1.

Referring now to FIG. 2, each discharge terminal 16 includes longitudinally extending primary chamber 30 lined with sound absorbing material 32 such as a glass fiber blanket. Primary chamber 30 ordinarily is open at both longitudinal ends, and a series of discharge terminals 16 may be connected end to end to provide a complete air discharge system. Suitable end pieces (not shown) are utilized to cap the end terminals in the series. Air supply distribution plate 34 having a plurality of collared openings 36 therein is provided to evenly distribute supply air from primary chamber 30 into distribution chamber 38, which is defined by the top and side walls of distribution plate 34. To provide an optimum air discharge pattern, the air supplied to distribution chamber 38 from primary chamber 30 should have minimal non-vertical velocity components, and collared openings 36 are designed, as is well known in the art, to guide the air passing therethrough so the velocity of the air stream in distribution chamber 38 is essentially vertical.

Discharge terminal 16 further includes air control means for controlling the amount of air discharged into a zone 11 by the discharge terminal. In the embodiment depicted in the drawing, the air control means includes a pressure responsive valve means, discussed immediately below, and connecting means, discussed in greater detail subsequently, for conducting a portion of the conditioned air passing through supply air duct means 14 to the pressure responsive valve means for controlling the amount of conditioned air discharged into zone 11. In the preferred embodiment, the pressure responsive valve means includes aligned cutoff plates 40 and inflatable bladders 42 and 44. Cutoff plates 40 are located at the bottom of distribution chamber 38 and are provided with curved surfaces 46 for engagement with bladders 42 and 44. As shown in FIG. 2, cutoff plates 40 are spaced from bladders 42 and 44, and air is discharged from distribution chamber 38 through the space between the cutoff plates and the bladders. The curvature of surfaces 46 smoothes the flow of air passing therepast to reduce the noise caused by the air as it is discharged from distribution chamber 38. Preferably surfaces 46 are covered with felt 48 to further reduce noise.

By varying the inflation of bladders 42 and 44, the size of the opening between the bladders and cutoff plates 40 may be varied. This feature can be employed to provide a variety of modes of terminal operation. If it is desired to discharge air from terminal 16 at a constant volumetric rate, a pressure responsive control may be utilized to inflate or deflate bladders 42 and 44 in response to supply air pressure to reduce the area between the bladders and cutoff plates 40 as duct pressure increases and to increase the area between the bladders and the cutoff plates as duct pressure decreases. If it is desired to control terminal 16 to provide a constant room temperature under varying cooling loads, bladder inflation may be controlled by a thermostat responsive to room temperature to provide an increased quantity of air flow from the terminal as the cooling load increases and a decreased quantity of air flow from the terminal as the cooling load decreases. As explained subsequently, the system depicted in the drawings, as is typical with such systems, employs both pressure responsive and temperature responsive controls.

Figure 3:
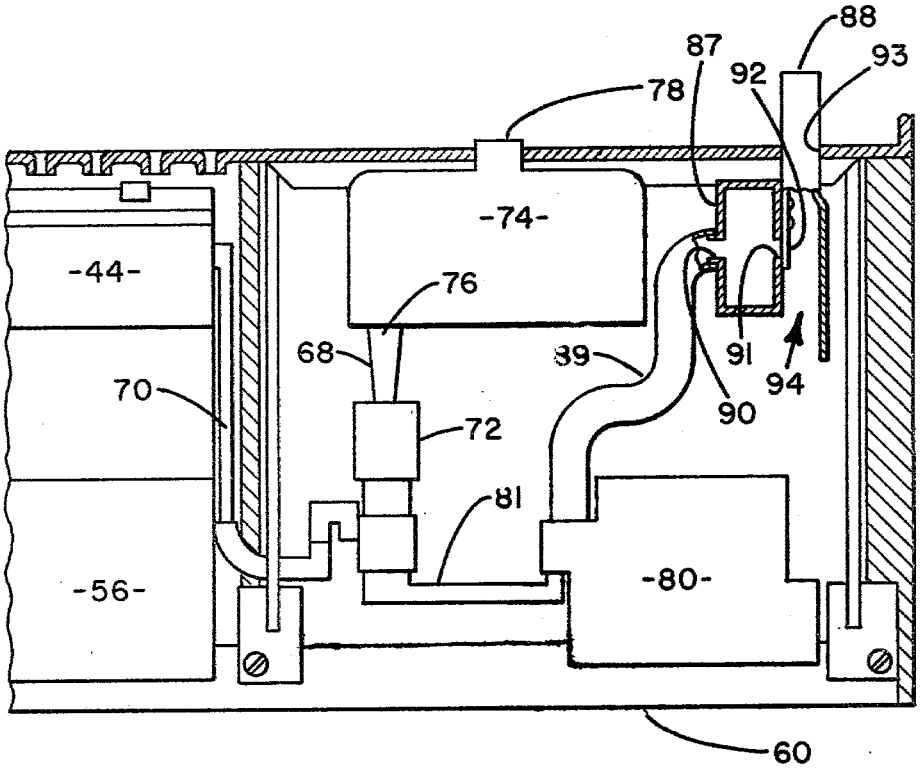
FIG. 3 is a side elevational view of a discharge terminal control module having a primary override means.
Figure 4:
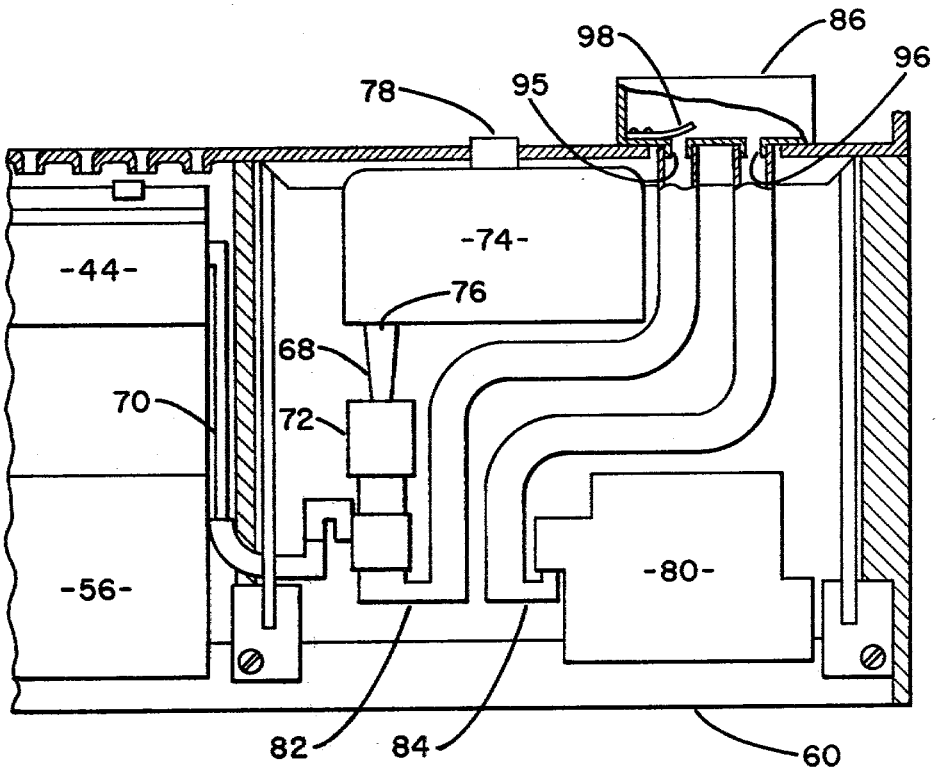
FIG. 4 is a side elevational view of a discharge terminal control module having an auxiliary override means.

After passing between bladders 42 and 44 and cutoff plates 40, the air discharged from distribution chamber 38 flows through air passages 50 defined by downwardly extending walls 52, outlet members 54, and a central partition assembly comprised of opposed, generally convex plates 56, diffuser triangle 58, and control module 60 (shown in FIGS. 3 and 4). Outlet members 54, having flared lower portions 62, are affixed, as by welding, to walls 52; diffuser triangle 58 is affixed, again as by welding, to convex plates 56; and the outlet members and diffuser triangle define discharge openings 64 of terminal 16. Preferably, bladders 42 and 44 are adhesively mounted within V-shaped recesses defined by convex plates 56 so that the bladders, when deflated, are substantially recessed within the convex plates. By recessing the deflated bladders 42 and 44 within convex plates 56, the maximum area between the bladders and cutoff plates 40 is increased, increasing the operating range of terminal 16. Further, the recessed bladders 42 and 44 provide a smooth surface along plates 56 to minimize noise and air turbulence. In addition, bladders 42 and 44 and cutoff plates 40 preferably are disposed a substantial distance upstream from discharge openings 64 to provide sufficient space therebetween to absorb any noise generated by the bladders and cutoff plates. For maximum sound absorption, downwardly extending walls 52 are lined with sound absorbing material such as glass fiber blanket 66.

Referring to FIGS. 3 and 4, the connecting means mentioned above includes ducts or conduits 68 and 70 and pressure regulator 72 for conducting a portion of the conditioned air passing through supply duct 14 to the pressure responsive valve or bladders 42 and 44 to provide a control signal therefor, wherein the magnitude of the control signal directly varies in response to changes in the pressure of the air passing through the supply duct. Preferably, pressure regulator 72 is of a type disclosed in U.S. Pat. No. 3,434,409 issued Mar. 25, 1969, in the name of Daniel A. Fragnito. Reference may be made to such patent for a complete description of pressure regulator 72. Further, filter 74 is preferably disposed between duct 68 and supply air duct 14, and duct 68 is in communication with the supply air duct via openings or ports 76 and 78 of the filter.

The controls for discharge terminal 16 also include thermostatic adjusting means for adjusting the air control means to directly vary the amount of air discharged into zone 11 in response to changes in the air temperature of the zone. The thermostatic adjusting means, in turn, includes bleed-off conduit means and thermostat 80. As shown in FIG. 3, the bleed-off conduit means includes duct or conduit 81; and, as shown in FIG. 4, the bleed-off conduit means includes ducts or conduits 82 and 84 with valve means 86, discussed in greater detail below, disposed therebetween. With both arrangements, the bleed-off conduit means is in communication with pressure regulator 72 for conducting air therefrom to reduce the pressure of air passing therethrough. Thermostat 80 is in thermal communication with the room serviced by terminal 16 and, in a manner well known in the art, regulates the amount of air passing through the bleed-off conduit means in response to changes in the room temperature. By regulating the amount of air passing through the bleed-off conduit means, thermostat 80 regulates the pressure drop caused thereby in the air passing through regulator 72. Preferably, thermostat 80 is of a type disclosed in U.S. Pat. No. 3,595,475 issued July 27, 1971, in the name of Daniel H. Morton. Reference may be made to such patent for a complete description of thermostat 80.

During normal operation, a portion of the air passing through supply duct 14 passes through filter 74 and regulator 72 and therefrom through duct 70 to bladders 42 and 44. A portion of the air fed to bladders 42 and 44 may be bled off through the bleed-off means discussed above, reducing the pressure of the air supplied to the bladders, with the amount of air bled off through the bleed-off means controlled by thermostat 80. As the temperature of the room serviced by terminal 16 increases, more air is bled off and bladders 42 and 44 deflate. In contrast, as the room temperature decreases, less air is bled off through the bleed-off means, and bladders 42 and 44 inflate. If it is desired to control bladders 42 and 44 independently, control module 60 may be provided with two pressure regulators 72 and two thermostats 80. This may be desirable, for example, when room air discharge terminal 16 is disposed above a room partition for individual temperature control on either side of the partition.

Generally, the air supplied from central air conditioning station 12 via supply duct 14 is at a relatively low temperature level to cool zones or rooms 11 in the building to desired temperature levels in accordance with the preferences of the individual occupants of such areas. During the evening hours, weekends, and holidays, in many buildings employing air conditioning systems of the general type herein described, many of the rooms or zones of the building are unoccupied, the machinery in these rooms is inoperative, and the lights therein are off, substantially reducing the cooling load in the rooms or areas. Although the thermostatic adjusting means operates to reduce the quantity of air discharged from the room terminals of the system to a minimum, generally the controls for an air conditioning system of the type described above are unable to entirely stop the flow of conditioned air into the zones or rooms served by the system. The continual, albeit minimal, flow of conditioned air may eventually reduce the temperature in such areas to an undesirably low level. Overcooling may also occur, even if the central air conditioning system is shut down, because of heat loss to the outdoors through the walls and windows of the building. When such areas are reoccupied, some occupants thereof may be uncomfortable as a result of such relatively low temperature levels.

In view of the foregoing, it is the practice in many applications to provide relatively warm air from central air conditioning station 12 to the room air discharge terminals 16 prior to the arrival of the occupants. The normal thermostatic adjusting means of discharge terminals 16 which serve the overcooled rooms of the building, sensing the very cool air within the rooms, tend to severely restrict the amount of warm air directed into these rooms, hampering efforts to quickly warm the rooms. Because of this tendency of the normal thermostatic adjusting means, a selected one or more discharge terminals 16 includes primary override means to override the normal thermostatic control to increase the amount of air discharged into a selected room or rooms during the warm-up period. Referring to FIG. 3, the primary override means includes warm-up switch 87, probe tube 88, and bypass line or hose 89. Warm-up switch 87 includes ports 90 and 91. Bypass line 89 leads from thermostat 80 to port 90 for conducting air from the thermostat without the normal regulation thereby. Bimetallic member 92 is disposed over port 91. Probe tube 88 extends through hole 93 defined by surfaces of duct 14 and transmits air from the duct, past bimetallic member 92, and thence to the ambient via opening 94 at the bottom thereof.

As noted hereinbefore, during normal operation, that is, when the supply of conditioned air is at a relatively low temperature level, air is delivered through filter means 74 to pressure regulator 72 and therefrom to inflatable bladders 42 and 44. During this normal operation, bimetallic member 92 is positioned over port 91, closing the port and preventing air flow through warm-up switch 87 and bypass hose 89. Air passing through bleed-off line 81 is directed through thermostat 80 so as to be regulated thereby. The control signal from pressure regulator 72 to inflatable bladders 42 and 44 is dependent upon the pressure of the supply air and the temperature of the space served by terminal 16 as sensed by thermostat 80. However, when the temperature of the air supplied through duct 14 is at a relatively high temperature level to warm the areas served by system 10, warm air is transmitted by probe tube 88 past bimetallic member 92. This warm air causes bimetallic member 92 to bend away from port 91, opening the port and allowing air to pass from bleed-off line 81 through by-pass line 89 and warm-up switch 87 and to the ambient via tube 88 and opening 94 thereof. The amount of air passing through bleed-off line 81 increases, decreasing the pressure of the air directed to bladders 42 and 44 via duct 70. Preferably, when port 91 is open, air from line 81 passes essentially unrestricted through hose 89, rendering thermostat 80 ineffective to vary the magnitude of the control signal supplied to bladders 42 and 44, and in effect fully opening bleed-off line 81 to deflate bladders 42 and 44. Thus, when the temperature of the air supplied via duct 14 is at a relatively warm temperature level, the control signal supplied from pressure regulator 72 to inflatable bladders 42 and 44 has a relatively small magnitude, and the amount of air discharged into zone 11 is relatively large. In this manner, an overcooled room or zone may be quickly warmed to a comfortable level.

However, not all rooms 11 of the building may need a warm-up period. For example, certain rooms or areas of a building may be occupied almost continuously. Other rooms may contain equipment which generate a relatively large amount of heat wherein these rooms rarely become overcooled even when left unoccupied for a period of time. The normal thermostatic adjusting means of discharge terminals 16 serving these rooms, sensing the relatively warm air within the rooms, tend to allow a relatively large amount of air into the rooms. This, of course, is desirable when system 10 is supplying cool air; but, during a warm-up period, directing warm air to these rooms represents a needless expense and, in fact, may cause discomfort to the occupants thereof and reduce the efficiency of the equipment therein. In order to eliminate this needless expense, discomfort, and reduced efficiency, in accordance with the present invention a selected one or more discharge terminal means 16 includes auxiliary override means for overriding the normal thermostatic control to substantially restrict the discharge of air into a selected zone or zones 11 during the warm-up period to prevent overheating thereof.

Referring to FIG. 4, the auxiliary override means includes valve means 86 located between conduits 82 and 84 for regulating the quantity of air passing therethrough. More specifically, valve 86 includes port 95 in communication with conduit 82, port 96 in communication with conduit 84, and temperature responsive bimetallic member 98 positioned over port 95. Preferably, valve 86 is located in plenum 30 or supply duct 14 wherein conditioned air passes over the valve as well as through the valve. During normal operating conditions, relatively cool air flows through supply duct 14, conduits 68 and 70, bleed-off conduits 82 and 84, and valve 86. This cool air maintains bimetallic member 98 in a position spaced from port 95, keeping valve 86 in an open position for allowing air to pass generally unrestricted therethrough. The magnitude of the control signal from pressure regulator 72 to inflatable bladders 42 and 44 is not affected by valve means 86 and is dependent upon the pressure of the supply air and the temperature of the space served by discharge terminal 16.

During a warm-up period, however, relatively warm air passes through supply duct 14, conduits 68, 70, 82 and 84 and valve 86. The warm air passing through valve 86, assisted by the warm air passing thereover, moves bimetallic member 98 toward port 95, restricting the passage of air therethrough. Valve means 86, thus, decreases the amount of air passing through conduits 82 and 84, increasing the pressure of the air directed to bladders 42 and 44. Preferably, during the warm-up period, valve means 86 moves to a closed position wherein bimetallic member 98 completely closes port 95, preventing air from passing through valve 86 and in effect preventing the thermostatic adjusting means from varying the magnitude of the control signal supplied to bladders 42 and 44.

Closing valve 86 maximizes the pressure of the air supplied to bladders 42 and 44, substantially restricting the amount of undesirable warm-up air directed to the room. This increases the comfort of the occupants of the room and may improve the efficiency of equipment located therein. Further, the total amount of warm air which system 10 must produce is decreased, reducing the cost of operation thereof.

With air conditioning system 10 described above, discharge terminals servicing those rooms requiring a warm-up period are provided with the primary override means, and the discharge terminals serving the rooms not needing a warm-up period are provided with the auxiliary override means. Hence, each room 11 serviced by system 10 may be selectively provided with warm-up air depending on the individual needs and requirements of the room. Moreover, many existing room air distribution terminals presently include, as shown in FIG. 3, pressure regulator 72 and thermostat 80, with a single duct or conduit 81 extending therebetween. Valve means 86 can easily be added to these existing distribution terminals by simply removing this single conduit 81 and substituting bleed-off conduits 82 and 84 therefor, and connecting ports 95 and 96 of valve means 86 to, respectively, conduits 82 and 84. Further, valve means 86 can easily be positioned inside duct 14 by removing warm-up switch 88, expanding hole 93 (referenced only in FIG. 3), and inserting valve means 86 through hole 93 and into duct 14. Hence, the above-discussed advantages of the present invention can be readily obtained on a retrofit basis.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. An air conditioning system for supplying conditioned air to a plurality of zones, the system comprising:

a central air conditioning station for conditioning air;

supply air duct means for conducting conditioned air from the central station to the zones; and a plurality of discharge terminal means for discharging conditioned air from the supply air duct means into the zones, wherein each terminal includes air control means for controlling the amount of conditioned air discharged into a zone by the discharge terminal, and thermostatic adjusting means for adjusting the air control means to directly vary the amount of air discharged into the zone in response to changes in the air temperature thereof; and wherein:

a first selected discharge terminal means further includes primary override means for overriding the thermostatic adjusting means of the first selected discharge terminal means to increase the amount of air discharged into a first selected zone during a warm-up period when the temperature of the air passing through the supply air duct means exceeds a predetermined value; and a second selected discharge terminal means further includes auxiliary override means for overriding the thermostatic adjusting means of the second selected discharge terminal means to substantially restrict the discharge of air into a second selected zone during the warm-up period to prevent overheating thereof.

2. A control for an air conditioning system of the type wherein a supply of air is conditioned at a central station, conditioned air is conducted through a supply air duct means to a plurality of zones, and a plurality of discharge terminal means discharge conditioned air from the supply air duct means into the zones, the control comprising:

a plurality of air control means, wherein each discharge terminal means includes an air control means for controlling the amount of conditioned air discharged into a zone by the discharge terminal means;

a plurality of thermostatic adjusting means, wherein each discharge terminal means includes a thermostatic adjusting means for adjusting the air control means to directly vary the amount of air discharged into the zone in response to changes in the air temperature thereof;

primary override means connected to first selected discharge terminal means for overriding the thermostatic adjusting means of the first selected discharge terminal means to increase the amount of air discharged into a first selected zone during a warm-up period when the temperature of the air passing through the supply air duct means exceeds a predetermined value; and auxiliary override means connected to second selected discharge terminal means for overriding the thermostatic adjusting means of the second selected discharge terminal means to substantially restrict the discharge of air into a second selected zone during the warm-up period to prevent overheating thereof.

3. The invention as defined by claims 1 or 2 wherein the auxiliary override means includes means for preventing the thermostatic adjusting means from varying the amount of air discharged into the second selected zone.

4. The invention as defined by claims 1 or 2 wherein:

the air control means includes a pressure responsive valve means, and connecting means for conducting a portion of the conditioned air passing through the supply air duct means to the pressure responsive valve means for controlling the amount of conditioned air discharged into the zone;

the thermostatic adjusting means includes means for inversely varying the pressure of the air passing through the connecting means in response to changes in the air temperature of the zone;

the primary override means includes means for reducing the pressure of the air passing through the connecting means of the first selected discharge terminal means during the warm-up period; and the auxiliary override means includes means for increasing the pressure of the air passing through the connecting means of the second selected discharge terminal means during the warm-up period.

5. The invention as defined by claim 4 wherein:

the thermostatic adjusting means includes bleed-off conduit means in communication with the connecting means for conducting air therefrom to reduce the pressure of air passing therethrough, and a thermostat located in heat transfer relation with the air in the zone for regulating the amount of air passing through the bleed-off conduit means and the pressure drop caused thereby in response to changes in the zone air temperature;

the primary override means includes primary override conduit means in communication with the supply air duct means and the bleed-off conduit means of the first selected discharge terminal means for conducting air therebetween, and a primary temperature responsive valve means in heat transfer relation with the air passing through the supply air duct means and having a closed position for preventing air from passing through the primary override conduit means and an open position for allowing air to pass therethrough, wherein the primary temperature responsive valve means changes from the closed position to the open position during the warm-up period; and the auxiliary override means includes an auxiliary temperature responsive valve in heat transfer relation with the air passing through the supply duct means and having a closed position for preventing air from passing through the bleed-off conduit means of the second selected discharge terminal means and an open position for allowing air to pass therethrough, wherein the auxiliary temperature responsive valve means changes from the open position to the closed position during the warm-up period.

* * * * *